US012318662B2

(12) United States Patent
Liao

(10) Patent No.: US 12,318,662 B2
(45) Date of Patent: Jun. 3, 2025

(54) GROUP EXERCISE SYSTEM AND METHOD FOR ADJUSTING PERSONAL EXERCISE LEVEL IN GROUP EXERCISE

(71) Applicant: Johnson Health Tech. Co., Ltd., Taichung (TW)

(72) Inventor: Hung-Mao Liao, Taichung (TW)

(73) Assignee: Johnson Health Tech Co., Ltd., Taichung (TW)

( * ) Notice: Subject to any disclaimer, the term of this patent is extended or adjusted under 35 U.S.C. 154(b) by 117 days.

(21) Appl. No.: 18/111,510

(22) Filed: Feb. 17, 2023

(65) Prior Publication Data

US 2024/0198178 A1 Jun. 20, 2024

(30) Foreign Application Priority Data

Dec. 20, 2022 (CN) ..... 202211636431.8

(51) Int. Cl.
*A63B 24/00* (2006.01)
*A63B 71/06* (2006.01)

(52) U.S. Cl.
CPC ..... *A63B 24/0075* (2013.01); *A63B 24/0062* (2013.01); *A63B 71/0605* (2013.01); *A63B 2024/0081* (2013.01)

(58) Field of Classification Search
CPC ..... A63B 24/0075; A63B 24/0062; A63B 71/0605; A63B 2024/0081; A63B 22/02; A63B 71/0622; A63B 2225/50
See application file for complete search history.

(56) References Cited

U.S. PATENT DOCUMENTS

| | | | | |
|---|---|---|---|---|
| 6,458,060 | B1 * | 10/2002 | Watterson | A63B 22/0235 482/4 |
| 2008/0207401 | A1 * | 8/2008 | Harding | A63B 24/0006 482/4 |
| 2015/0220883 | A1 * | 8/2015 | B'Far | G06Q 10/105 700/91 |
| 2015/0273272 | A1 * | 10/2015 | Wang | A63B 24/0075 700/91 |
| 2018/0280782 | A1 * | 10/2018 | Lagree | A63B 21/0428 |
| 2020/0054922 | A1 * | 2/2020 | Azaria | A63B 24/0087 |
| 2022/0223254 | A1 * | 7/2022 | Foley | A63B 24/0062 |
| 2024/0203559 | A1 * | 6/2024 | Foley | A63B 22/06 |

* cited by examiner

*Primary Examiner* — Megan Anderson
*Assistant Examiner* — Andrew M Kobylarz

(57) ABSTRACT

A group exercise system includes an exercise instructing equipment, a plurality of exercise participating equipment, a leaderboard module and a level instruction module. The exercise instructing equipment have a first electronic device providing a demonstration exercise information which includes an exercise level of a first exercise apparatus used by a trainer to perform a demonstration exercise. The plurality of exercise participating equipment each have a second exercise apparatus and a second electronic device, and the second electronic device adjusts an exercise level of the second exercise apparatus used by a participant to perform a simulation exercise. The leaderboard module is configured to update a performance ranking. The level instruction module is configured to instruct the second electronic devices of all the exercise participating equipment to adjust the exercise level of the second exercise apparatus according to the exercise level of the first exercise apparatus at one or more adjustment times.

9 Claims, 6 Drawing Sheets

GROUP EXERCISE SYSTEM AND METHOD FOR ADJUSTING PERSONAL EXERCISE LEVEL IN GROUP EXERCISE

BACKGROUND

1. Field of the Invention

The present invention relates to an exercise training using exercise apparatus. More particularly, the present invention relates to a group exercise system which enables many people performing the same exercise simultaneously, and a method for adjusting personal exercise level in the group exercise.

2. Description of the Related Art

Group exercise is a popular exercise type for many people exercising together that improves the enjoyment and exercise performance, and using exercise apparatuses such as stationary bicycles or treadmills in the group exercise are conducted in recent years. The group exercise is usually leaded by a trainer (such as a coach in a fitness club) who performs an exercise using an exercise apparatus, and multiple participants follow the trainer's instructions to simulate the exercise by using the same or similar exercise type of exercise apparatuses in a live event or through a real-time live video. Or an operator may provide pre-record videos of many exercise classes on a network platform, the participants at different places can simultaneously receive and watch the pre-recorded video of a selected exercise class in a streaming manner, and the participants can follow exercise instructions in the pre-recorded video to simulate the exercise. In an advanced type of group exercise, the participants can see their performance ranking (such as a ranking of accumulated distance or burned calories) in the group exercise, it help the participants to self-assess and self-motivate.

Basically, when the participants follow the trainer to perform the exercise, an exercise level (such as a pedal resistance of a stationary bicycle, a belt speed of a treadmill or a deck incline degree of a treadmill) of the exercise apparatuses used by the participants shall be the same with an exercise level used by the trainer, so all the participants shall achieve the trainer's expected exercise performance in the group exercise. In the earlier days, an easy way of synchronizing the exercise level used by the trainer and the exercise level used by the participants is that the trainer asks the participants to adjust the exercise level, such as the trainer asks all the participants with saying "Now, adjust the exercise level to Lv. 10", and the participants shall follow the trainer's instruction to adjust the exercise level of their exercise apparatus to Lv. 10 by inputting a command on a user interface of the exercise apparatus. An advanced way of adjusting exercise level is using a computer which is equipped on the exercise apparatus to control the exercise level, and the exercise apparatus used by the trainer can connect to the exercise apparatuses used by the participants via wired or wireless connection for synchronizing the exercise level of all exercise apparatuses in the group exercise.

However, there may be some participants in the group exercise whose fitness level is lower than an average fitness level of all participants because they are not good at this exercise. If these participants keep using the same exercise level in the group exercise, they may feel exhausted and may give up to finish the group exercise. The method for adjusting exercise level mentioned above allows the participants disable the exercise level synchronizing when they cannot keep up with the trainer, and the participants may set an appropriate exercise level while performing the group exercise. In other situations, the participants may cannot achieve the exercise level used by the trainer, so they set lower exercise level before the beginning of the group exercise. For example, when the trainer guides the participants to used exercise level Lv. 8 to perform the group exercise, the participants may feel too difficult and manually degrade the exercise level from Lv. 8 to Lv. 6; or when the trainer upgrade the exercise level to Lv. 10, the participants may degrade the exercise level to Lv. 7 or Lv. 8. In contrast, the participants who have better fitness level may think that the exercise level used by most participants is too low and want to upgrade the exercise level. Although the method for adjusting exercise level mentioned above is flexible in the group exercise, but the participants who don't want to synchronize the exercise level with the trainer's exercise level have to keep watch the exercise level changes in the group exercise (especially a high intensity interval training workout with alternating periods of high intensity and low intensity) and have to manually adjust the exercise level of the exercise apparatus when the exercise level is changed. So it is difficult for the participants being concentrated on performing the group exercise, and the exercise level adjusted by each participant may affect expected performance of the group exercise.

SUMMARY

The object of the present invention provides a group exercise system which enables participants getting appropriate training profile and exercise results that meet their fitness level, so that the exercise interest and motivation can be improved in the group exercise. And the participants won't be distracted from manually adjusting the exercise level of the exercise apparatuses.

The another object of the present invention provides a method for adjusting exercise level in group exercise which enables participants getting appropriate training profile and exercise results that meet their fitness level, so that the exercise interest and motivation can be improved in the group exercise. And the participants won't be distracted from manually adjusting the exercise level of the exercise apparatuses According to one aspect of the present invention, a group exercise system have an exercise instructing equipment, a plurality of exercise participating equipment, a leaderboard module and a level instruction module. The exercise instructing equipment have a first electronic device which provides a demonstration exercise information of a trainer performing a demonstration exercise using a first exercise apparatus, and the demonstration exercise information includes an exercise level of the first exercise apparatus used by the trainer to perform the demonstration exercise. The plurality of exercise participating equipment each have a second exercise apparatus and a second electronic device, and the plurality of exercise participating equipment enable a plurality of participants to perform a simulation exercise which is simulating the demonstration exercise using the respective second exercise apparatuses during a group exercise period, the second electronic device of each exercise participating equipment is operable to adjust, according to a command, an exercise level of the corresponding second exercise apparatus used by each participant to perform the simulation exercise and continuously measures a performance data of each participant during the group exercise period. The leaderboard module continuously update a performance ranking according to the performance data of each participant performing the simulation exercise during the group exercise period. The level instruction module instructs the second electronic devices of all the exercise participating equipment to adjust, according to the exercise level of the first exercise apparatus used by the trainer performing the demonstration exercise, the exercise level of the second exercise apparatus used by each participant performing the simulation exercise; and at one or more adjustment times in the group exercise period, the level instruction module instructs the second electronic device of each exercise participating equipment to adjust, according to the performance ranking of each participant, the exercise level of the second exercise apparatus.

Preferably, the leaderboard module is operable to display the performance ranking to the plurality of participants during the group exercise period, and the level instruction module is operable to periodically instruct the second electronic device of each exercise participating equipment to adjust, according to the corresponding performance ranking, the exercise level of the second exercise apparatus during the group exercise period. Furthermore, the level instruction module is operable to instruct the second electronic device of the exercise participating equipment corresponding to one of the plurality of participants whose performance ranking is in a lower ranking range to adjust the exercise level of the second exercise apparatus to be lower than the exercise level of the first exercise apparatus. The lower ranking range includes the last two rankings, and the exercise level of the corresponding second exercise apparatus is adjusted to be lower if the performance ranking of the participant is lower.

Preferably, the demonstration exercise information includes a performance data of the trainer performing a demonstration exercise using the first exercise apparatus, and the level instruction module instructs the second electronic device of the exercise participating equipment corresponding to the one of the plurality of participants whose performance ranking is in the lower ranking range and whose performance data is worse than a predetermined degree of the performance data of the trainer to adjust the exercise level of the corresponding second exercise apparatus to be lower than the exercise level of the first exercise apparatus.

Preferably, the level instruction module is operable to instruct the second electronic device of the exercise participating equipment corresponding to one of the plurality of participants whose performance ranking is in a higher ranking range to adjust the exercise level of the corresponding second exercise apparatus to be higher than the exercise level of the first exercise apparatus. The higher ranking range includes the first two rankings, and the exercise level of the second exercise apparatus is adjusted to be higher if the performance ranking of the participant is higher.

Preferably, the demonstration exercise information includes a performance data of the trainer performing a demonstration exercise using the first exercise apparatus, and the level instruction module instructs the second electronic device of the exercise participating equipment corresponding to the one of the plurality of participants whose performance ranking is in the better ranking range and whose performance data is larger than a predetermined degree of the performance data of the trainer to adjust the exercise level of the second exercise apparatus to be higher than the exercise level of the first exercise apparatus at one or more adjustment times.

Preferably, the second electronic device of each exercise participating equipment is provided for allowing the participants to decide whether to accept adjustment of the exercise level instructed by the level indication module according to the performance ranking.

According to another aspect of the present invention, a method for adjusting exercise level in a group exercise, the group exercise is provided for allowing a plurality of participants respectively using a second exercise apparatus to simultaneously perform a simulation exercise which is simulating a demonstration exercise performed by a trainer using a first exercise apparatus, the method comprising: adjusting, according to an exercise level of the first exercise apparatus used by the trainer to perform the demonstration exercise, an exercise level of the second exercise apparatus used by each participant to perform the simulation exercise; during the group exercise period, continuously measuring a performance data of each participant performing the simulation exercise and updating a performance ranking of each participant according to the performance data; and at one or more adjustment times in the group exercise period, adjusting the exercise level of the second exercise apparatus corresponding to one of the plurality of participants whose performance ranking is in a lower ranking range to be lower than the exercise level of the first exercise apparatus, and/or adjusting the exercise level of the second exercise apparatus corresponding to one of the plurality of participants whose performance ranking is in a higher ranking range to be higher than the exercise level of the first exercise apparatus.

Further benefits and advantages of the present invention will become apparent after a careful reading of the detailed description with appropriate reference to the accompanying drawings.

DETAIL DESCRIPTION

Figure 1:
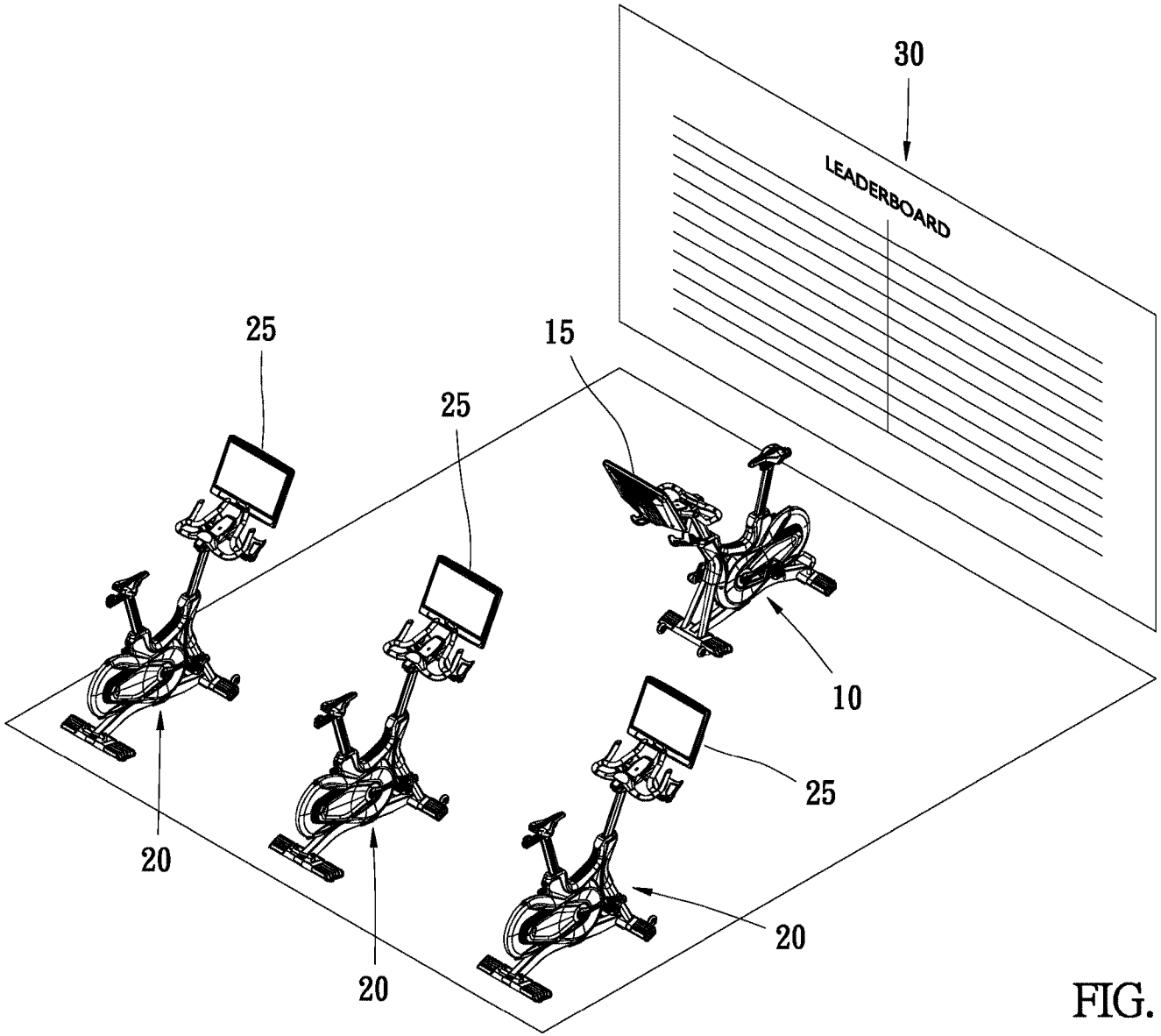
FIG. 1 illustrates relative position relationship between some equipment of a group exercise system in accordance with a preferred embodiment of the present invention.
Figure 2:
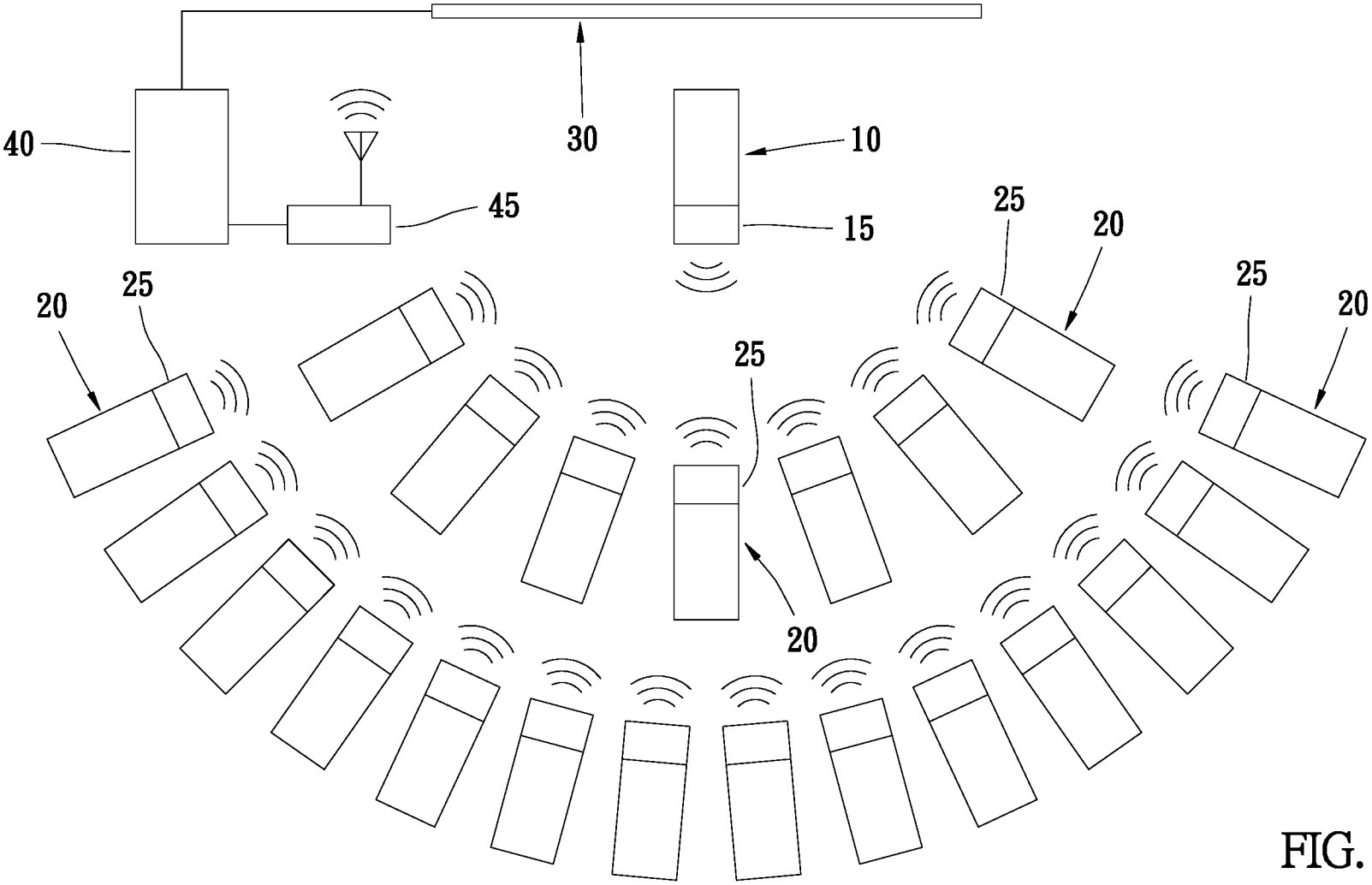
FIG. 2 illustrates a basic configuration of the group exercise system in accordance with a preferred embodiment of the present invention.

Referring to FIG. 1 and FIG. 2, a preferred embodiment of a group exercise system includes a first exercise apparatus 10 and a plurality of exercise apparatuses 20. FIG. 1 shows a reference arrangement of the group exercise system including three exercise apparatuses 20. FIG. 2 is a block diagram of the group exercise system showing a position arrangement of the plurality of exercise apparatuses 20 related to the first exercise apparatus 10. The first exercise apparatus 10 enables a trainer to perform a specific type exercise during a group exercise period, and the plurality of exercise apparatuses 20 respectively enable a plurality of participants to perform the same type exercise at the same time. The first exercise apparatus 10 and the second exercise apparatuses 20 enable the trainer and the participants to perform the same type or similar type exercise with the same or the similar structure.

In the preferred embodiment of the present invention, the first exercise apparatus 10 and the second exercise apparatuses 20 are stationary bicycles. More precisely, the first exercise apparatus 10 and the second exercise apparatuses 20 are spinning bike including a seat cushion for a user (such as the trainer or the participant) to sit, a set of handles for a user to grasp, a set of pedals for a user to step on, a flywheel rotated in conjunction with the set of pedals, and a resistance component for changing pedal resistance. The resistance component could be an eddy current brake (ECB) or a friction brake to apply resistance to the flywheel. The first exercise apparatus 10 and the second exercise apparatuses 20 both enable the user to perform spinning exercise. Basically, the user steps on the pedals to rotate the flywheel to perform cycling exercise, and the user can execute different exercise profiles by changing different pedal resistance, different pedal cadence and different the riding posture during the exercise. In the preferred embodiment of the present invention, the pedal resistance of exercise apparatuses 10, 20 represents an exercise level. It should be mentioned here, the exercise level of the present invention is different from the exercise intensity. The exercise intensity usually represents exertion level of the human body performing an exercise (such as heart rate of a user).

The used exercise apparatuses in the group exercise of the present invention is not limited to spinning bike or stationary bicycle, in other embodiments, exercise apparatuses including adjustable resistance component can be used in the group exercise, for example, the exercise apparatus could be an electric treadmill, an non-electric treadmill, an elliptical, a stair exerciser apparatus, a steppers machine, or a rowing machine, etc. And the exercise level is not limited representing the pedal resistance of the spinning bike, it could represents a belt speed of the treadmill, an incline angle of the elliptical, or a stage resistance of the steppers machine, etc. The exercise level of the exercise apparatus can be quantified and adjusted, and the exercise level associates with an exercise difficulty for a user performing the exercise. The structure, motion mechanisms and exercise level adjustment of the respective exercise apparatuses are technological background of the art, the specific structures are not substantially connected to the content of the present invention so the details are not be mentioned the specification.

For ease of distinction, in the present invention, the exercise performed by the trainer using the first exercise apparatus 10 during the group exercise period is called a demonstration exercise, and the exercise performed by the participants using the respective second exercise apparatuses 20 during the group exercise period is called a simulation exercise, the simulation exercise performed by the participants is simulating the demonstration exercise. Basically, in the group exercise, the trainer performs the demonstration exercise described in an exercise program (sometimes the trainer may perform different motions) and keeps guiding and motivating the participants with verbal encouragement. The participants follow the trainer's motions to perform the simulation exercise at the same time. In the preferred embodiment of the present invention, the participants may try to achieve the same pedal resistance, the same pedal cadence or the same riding posture with the trainer in the group exercise.

A console 15 is equipped at the front end of the first exercise apparatus 10 and a console 25 is equipped at the front end of each second exercise apparatus 20, the console 15 and the console 25 are used as user interfaces for users controlling the exercise apparatuses. In the preferred embodiment of the present invention, the consoles 15 and 25 each has a flat touch-panel display that allow users watching exercise information and inputting commands. The consoles 15 and 25 could respond to a command (from a user or a remote station) for adjusting the pedal resistance by controlling the resistance component, for example, the command is controlling magnets of the eddy current brake to close to the flywheel or far from the flywheel, or the command is controlling a friction pad of the friction brake to being engaged the flywheel or being disengaged the flywheel. So that the exercise level of the first exercise apparatus 10 and the exercise level the second exercise apparatuses 20 could be adjusted by increasing or decreasing the pedal resistance. As mentioned above, exercise level adjustment by controlling the resistance components is technological background of the art.

One or more sensors (not shown) may couple to the consoles 15 and 25 for measuring performance data of users performing exercises using the first exercise apparatus 10 and the second exercise apparatuses 20 separately. The exercise apparatus is illustrated as a spinning bike in the preferred embodiment, and the performance data may be a score calculated by one or combination of exercise parameters, such as accumulated distance, burned calories or average consumption power. And the one or more sensors may generate sensing data such as pedal resistance, rotation speed or the revolutions of the flywheel, the sensing data would be transmitted to the consoles 15 and 25 for measuring the performance data. As mentioned above, exercise performance data measurement by using various type of sensors are technological background of the art.

In the referred embodiment, the first exercise apparatus 10 and the second exercise apparatuses 20 are located at the same place, such as a fitness club, an indoor area or an outdoor area. FIG. 2 is an ordinary position arrangement that shows each second exercise apparatus 20 facing toward the first exercise apparatus 10, so that all the participants using the second exercise apparatuses 20 can see the trainer using the first exercise apparatus 10 and the trainer can also see the most of the participants.

A large screen 30 is placed in front of the second exercise apparatuses 20 and behind the first exercise apparatus 10. The large screen 30 is constructed by arranging several flat displays together that allows the participants seeing an exercise information, and the displayed exercise information on the large screen 30 is controlled by a computer 40. In other embodiments, the large screen 30 is a projection screen and the computer 40 controls a projector (not shown) to project the exercise information on the large screen 30.

The computer 40 can connects to the first exercise apparatus 10 and the second exercise apparatuses 20 via a bi-directional communication medium. In the preferred embodiment of the present invention, the consoles 15 and 25 include a wireless bi-directional communication medium and the computer 40 is electrically coupled to a wireless communication device 45, the consoles 15 and 25 can communicate with the computer 40 via the wireless bi-directional communication medium such as Wi-Fi or Bluetooth, etc. In some embodiments, the consoles 15 and 25 may direct or in-direct connect to the computer 40 via wired connection interfaces. The console 15 of the first exercise apparatus 10 may transmit the exercise level used by the trainer and the performance data of the trainer performing the demonstration exercise to the computer 40, and the console 25 of each second exercise apparatus 20 may transmit personal information (such as a login account and an avatar) of each participant, the exercise level used by each participant and the performance data of each participant performing the simulation exercise to the computer 40. Similarly, the computer 40 may transmit exercise information (also called demonstration exercise information which includes the exercise level used by the trainer) of the trainer performing the demonstration exercise to the console 25, and the computer 40 may transmit the personal information and exercise information of the participants to the console 15.

In accordance with the concept of the present invention, a first electronic device can be constructed by the console 15 of the first exercise apparatus 10, the one or more sensors, the computer 40 and the wireless communication device 45, and an exercise instructing equipment is constructed by the first exercise apparatus 10 and the first electronic device. A second electronic device may be constructed by the console 25 of the second exercise apparatus 20 and the one or more sensors, and an exercise participating equipment is constructed by the second exercise apparatus 20 and the second electronic device.

In the group exercise, the trainer performs the demonstration exercise using the first exercise apparatus 10, and the participants (the number of the participants usually more than ten to dozens of people) perform the simulation exercise using the second exercise apparatus 20 to simulate the demonstration exercise at the same time. If the trainer guides the participants to adjust the exercise level (the exercise level could be an initial exercise level before the group exercise start), the trainer will input an exercise level adjustment command through the console 15 of the first exercise apparatus 10, the command may include a specific adjusted resistance or an increasing degree or an decreasing degree of exercise level from the current exercise level. And the console 15 not only controls the resistance components of the first exercise apparatus 10 based on the command, but also transmits the exercise level adjustment command to the computer 40. Basically, the computer 40 transmits the same command to all the exercise participating equipment for controlling the resistance components of all the second exercise apparatuses 20, so that the exercise level used by all the participants are synchronized to the exercise level used by the trainer. In the group exercise, the trainer keeps guiding and motivating the participants with verbal encouragement, so the trainer will informs the participants of exercise level change in advance.

The second electric device of each exercise participating equipment continuously measures the performance data of each participant performing the simulation exercise, and the second electric device transmits the performance data to the computer 40 of the exercise instructing equipment. The performance data might be transmitted every 10 or 15 seconds. It should be mentioned that although all the participants using the same exercise level in the group exercise, but each participant might have different pedal cadences or different revolutions of the flywheel, so the performance data (such as burned calories) of the participants shall be different, and the performance data gap between different participants might become larger over time. The computer 40 will continuously collect the performance data transmitted by the console 25 of the exercise participating equipment and the computer 40 continuously update a performance ranking by ranking the performance data of the participants every 10 or 15 seconds. And the performance ranking is displayed on the large screen 30 for all the participants seeing their ranking.

Figure 5:
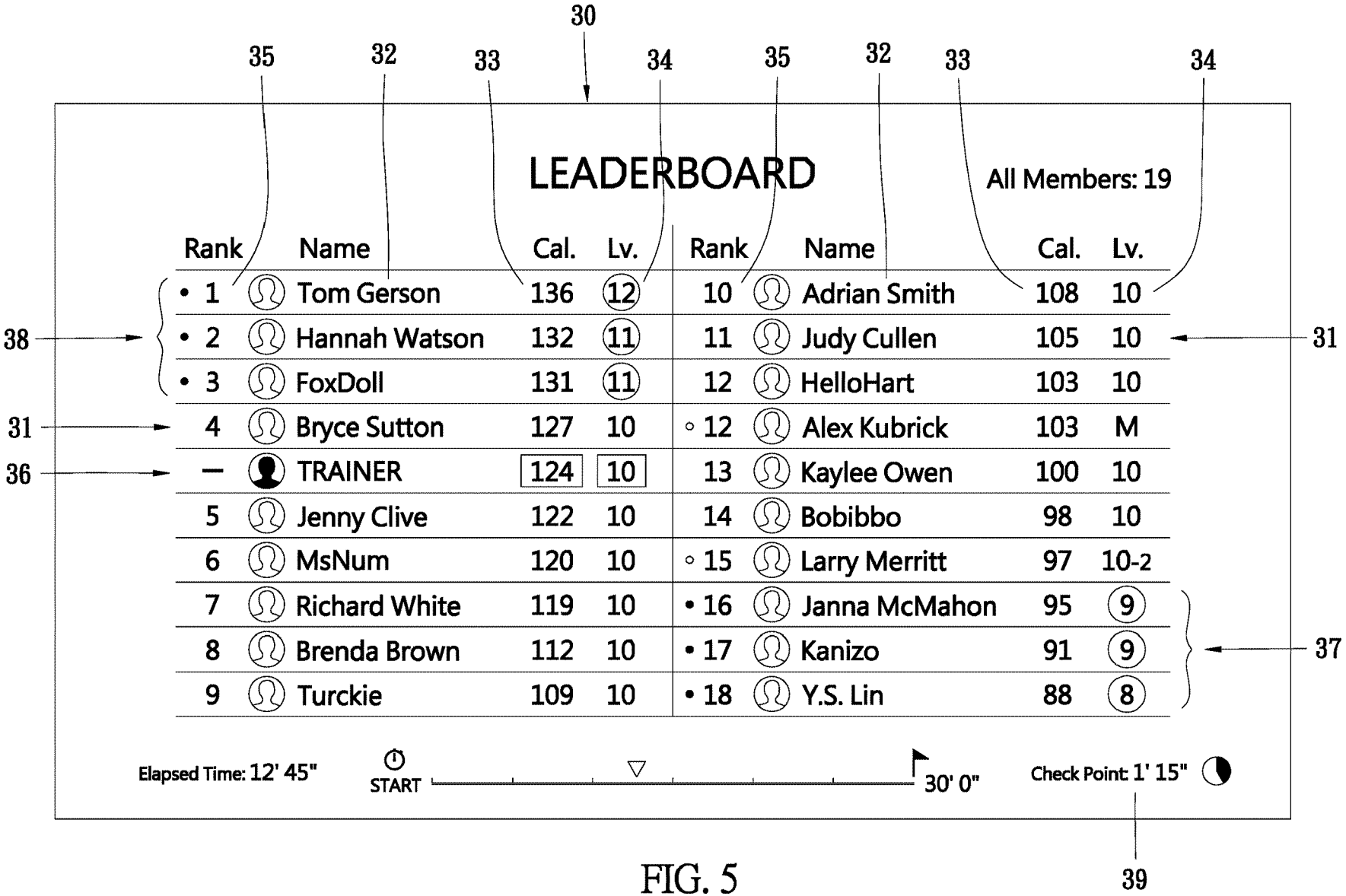
FIG. 5 illustrates a leaderboard example of performing the group exercise using a technical solution of the present invention.

FIG. 5 illustrates the displayed exercise information on the large screen 30 during the group exercise period. In the preferred embodiment of the present invention, the performance ranking shown in a leaderboard is listed from the highest performance to the lowest performance (from the first ranking to the fifteenth ranking in FIG. 5). In the leaderboard, the briefed personal information 31 of each participant is described in a raw, and the briefed personal information 31 includes a name 32, an avatar, a performance data 33, an exercise level 34 and a performance ranking 35. The briefed personal information 36 of the trainer is also described in a raw, the performance data of the trainer is ranked together with the performance data of all the participants, but the performance ranking of the trainer won't be shown in the leaderboard. The performance data 33 illustrated in FIG. 5 is burned calories of each participant in the group exercise, and the performance data 33 can be calculated by pedal resistance, rotation speed or revolutions of the flywheel. A larger value of the performance data represents a greater exercise results. In other embodiments, the performance data may be calculated by one or combination of exercise parameters such as accumulated distance or average consumption power, etc. With regard to the participants whose performance data be significantly behind the average (such as the participant's performance data is in a lower ranking range), the exercise level used in the group exercise may be too high (also means too difficult) for them; and on the contrary, with regard to the participants whose performance data be significantly ahead of the average (such as the participant's performance data is in a higher ranking range), the exercise level used in the group exercise may be too low (also means too easy) for them.

In the preferred embodiment of the present invention, at one or more adjustment times in the group exercise, the computer 40 of the exercise instructing equipment instructs, by transmitting the command, the console 25 of each exercise participating equipment to adjust the exercise level of the corresponding second exercise apparatus 20 which is used by each participant performing the simulation exercise according to the performance ranking of each participant.

Referring to FIG. 5, the trainer uses Lv. 10 as the exercise level in the group exercise, and basically, all participants shall use Lv. 10 as the exercise level at the same time. But at the one or more adjustment times in the group exercise, the computer 40 instructs the console 25 of each exercise participating equipment corresponding to one of the participants whose performance ranking is in the lower ranking range (such as the last 3 rankings 37 in FIG. 5) to adjust the exercise level of the second exercise apparatus 20 to be lower than the exercise level of the first exercise apparatus 10. And the exercise level is adjusted to be lower if the performance ranking of the participant is lower, for example, the exercise level used by the last participant is adjusted to Lv. 8 and the exercise level used by the last but one participant and the last but two participant is adjusted to Lv. 9.

Meanwhile, the computer 40 instructs the console 25 of each exercise participating equipment corresponding to one of the participants whose performance ranking is in the higher ranking range (such as the first 3 rankings 38 in FIG. 5) to adjust the exercise level of the second exercise apparatus 20 to be higher than the exercise level of the first exercise apparatus 10. And the exercise level is adjusted to be higher if the performance ranking of the participant is higher, for example, the exercise level of the first place participant is adjusted to Lv. 12 and the exercise level of the second place participant and the third place participant is adjusted to Lv. 11.

Preferably (not shown in FIG. 5), at the one or more adjustment times, the computer 40 only instructs the console 25 of each exercise participating equipment corresponding to the participant whose performance ranking is in the higher ranking range and whose performance data is better than a predetermined degree of the trainer's performance data to adjust the exercise level of the second exercise apparatus 20 to be higher than the exercise level of the first exercise apparatus 10. For example, if the first place participant's performance data is worse than the trainer's performance data, or if the first place participant's performance data doesn't better than the predetermined degree of the trainer's performance data (such as 110% of the trainer's performance data), the exercise level of the second exercise apparatus won't be adjusted, that is, the exercise level used by the participants performing the simulation exercise is the same with the exercise level of the trainer performing the demonstration exercise.

Similarly, at the one or more adjustment times, the computer 40 only instructs the console 25 of each exercise participating equipment corresponding to the participant whose performance ranking is in the lower ranking range and whose performance data is worse than a predetermined degree of the trainer's performance data to adjust the exercise level of the corresponding second exercise apparatus 20 to be lower than the exercise level of the first exercise apparatus 10. For example, if the last participant's performance data is better than the trainer's performance data, or if the last participant's performance data doesn't worse than the predetermined degree of the trainer's performance data (such as 10% of the trainer's performance data), the exercise level of the second exercise apparatus won't be adjusted, that is, the exercise level used by the participants performing the simulation exercise is the same with the exercise level of the trainer performing the demonstration exercise.

The leaderboard in FIG. 5 could display 20 personal information at the same time, and in the preferred embodiment of the present invention, it is assumed that there are 19 participants and 1 trainer in the group exercise, so the personal information of all participants can be displayed in the leaderboard. In other embodiments, there may be more than 20 participants joining the same group exercise, so the performance ranking in the leaderboard may be shown in a loop playback manner, or the leaderboard may only display some participants' personal information, such as showing the performance information of the participant whose performance data is in the higher ranking range or in the lower ranking range. For example, the leaderboard only shows the personal information of the participant whose performance data is in the highest 10 rankings and in the lowest 10 rankings. The computer 40 not only controls the large screen 30 showing the performance ranking, but also transmits information to the console 25 of each exercise participating equipment. The console 25 of each second exercise apparatuses 20 displays the performance ranking to the corresponding participant, and the information displayed by the console 25 may be different from the leaderboard displayed by the large screen 30. The performance ranking of the corresponding participant displayed by the console 25 usually be highlighted, so the participant can easily notice his/her performance ranking among all participants.

The total number of the second exercise apparatuses adjusted exercise level depends on the total number of participants joining the group exercise. For example, if there are 50 participants joining the group exercise, the exercise level used by the participants whose performance ranking only in the highest 5 rankings and/or in the lowest 5 rankings will be adjusted. And if there are 10 participants in the group exercise, only the exercise level used by the highest ranking participant and/or the lowest ranking participant will be adjusted.

Figure 6:
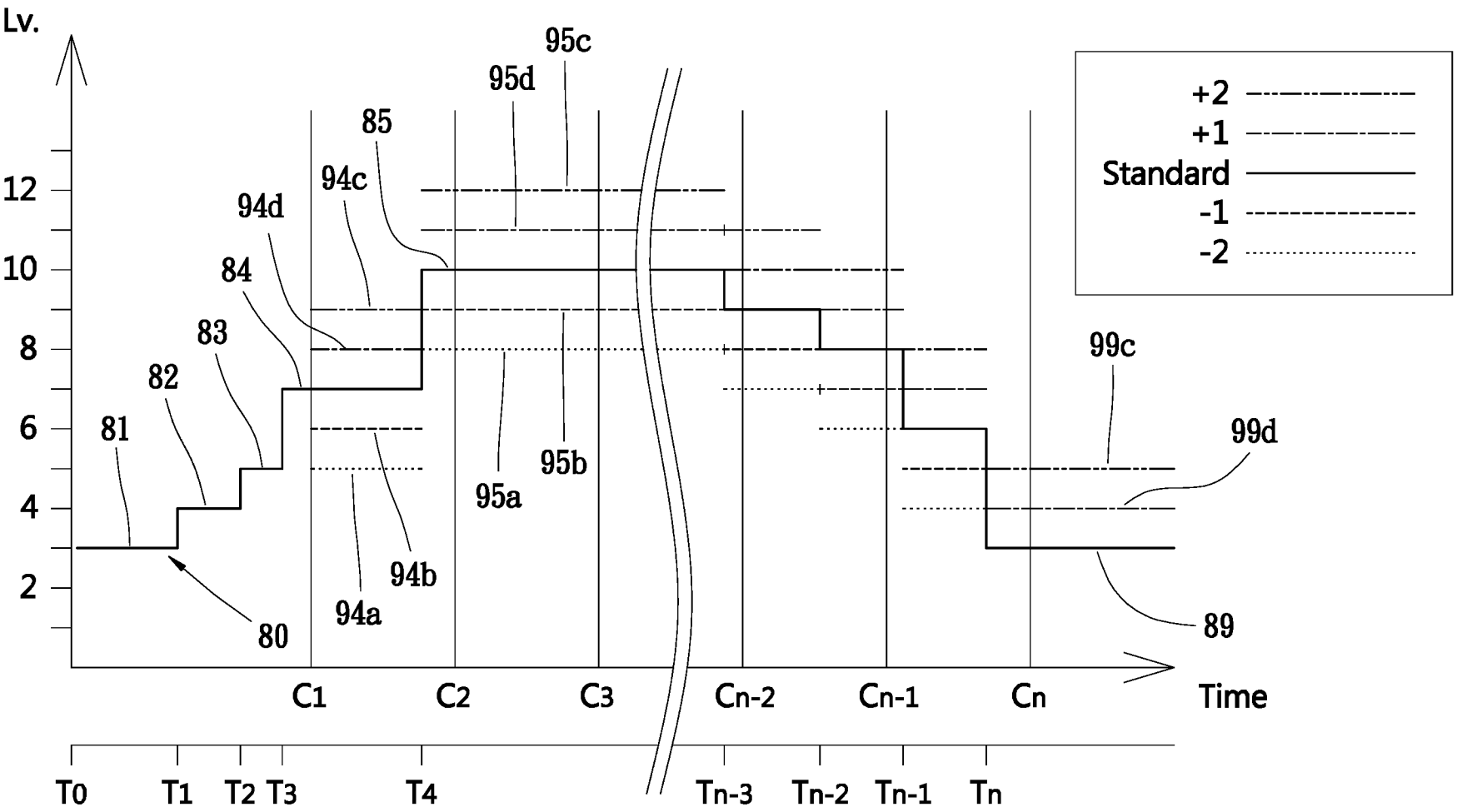
FIG. 6 illustrates an example of a time series change of a standard exercise level and an adjusted exercise level of performing the group exercise using a technical solution of the present invention.

FIG. 6 illustrates an example of a time series change of a standard exercise level and an adjusted exercise level of performing the group exercise with a technical solution of the present invention. In FIG. 6, the horizontal axis represents time, the vertical axis represents the used exercise level, and a standard exercise level curve 80 (the bending bold line in FIG. 6) represents a time series change of the standard exercise level which is the used exercise level of the trainer performing the demonstration exercise. The time point TO represents the group exercise start and the time point T1 to Tn represents the time of the trainer guiding the participants to adjust the exercise level. In FIG. 6, the initial exercise level is Lv.3 and the trainer adjusts the exercise level to Lv.4 at time T1 and then to Lv. 5 at time T2. The maintained exercise level of the standard exercise level curve 80 in every interval is called an interval exercise level, and the interval exercise level is labeled 81, 82, 83 . . . 89. The C1 to Cn labeled on the time axis represent checkpoints corresponding to the time T0 to Tn, and the time intervals between two adjacent checkpoints usually are the same, for example, the checkpoint C1 may be set at 5 minutes after the group exercise start and the following checkpoints are set at every 3 minutes.

At every checkpoints, the computer 40 determines whether to instruct the second exercise apparatuses 20 to adjust the exercise level according to the performance ranking of the participants. For example, at the checkpoint C1, the computer 40 determines that the exercise level used by the last participant shall be degraded two levels, the exercise level used by the last but one participant and the last but two participant shall be degraded one level, the exercise level used by the first place participant shall be upgraded two levels and the exercise level used by the second place and the third place shall be upgraded one level. So after the checkpoint C1, the interval exercise level 84 used by the most of the participants is Lv. 7, but the interval exercise level 94*a* used by the last participant is adjusted to Lv. 5, the interval exercise level 94*b* used by the last but one participant and the last but two participant is adjusted to Lv. 6, the interval exercise level 94*c* used by the first place participant is adjusted to Lv. 9 and the interval exercise 15 level 94*d* used by the second place participant and the third place participant is adjusted to Lv. 8.

Next, the trainer adjusts the exercise level to Lv. 10 as the interval exercise level 85 at time T4. Based on the received demonstrate exercise information from the computer 40 and a monitor function of the console 25 of each exercise participant equipment, the adjusted exercise level degree of each participant is still the same with the adjusted exercise level degree at C1. That is, there is no need for the computer 40 instructing the console 25 to adjust the exercise level, the console 25 can automatically adjust exercise level when the exercise level used by the trainer is changed. For example, at time T4, the interval exercise level 95*a* used by the last participant is adjusted to Lv. 8, the interval exercise level

95*b* used by the last but one participant and the last but two participant is adjusted to Lv. 9, the interval exercise level 95*c* used by the first place participant is adjusted to Lv. 12 and the interval exercise level 95*d* used by the second place participant and the third place participant is adjusted to Lv. 11. The exercise level may be adjusted at the next exercise level change or the next checkpoint.

Referring to FIG. 5, a time notification 39 is displayed in the lower right corner of the large screen 30, and the time notification 39 represents the remaining time to the next checkpoint. The time notification 39 might be displayed on the console 25 of each exercise participant equipment, so each participant (particularly of the participant whose ranking is in the higher ranking range or in the lower ranking range) could know the remaining time of next exercise level change.

It is worth mentioning that, in FIG. 6, the final interval exercise level 89 of the standard exercise level curve 80 is Lv. 3 which is lower than a default exercise level, so the computer 40 will only upgrade the exercise level used by the participants. For example, the exercise level be upgraded two levels to Lv. 5 as interval exercise level 99*c* or the exercise level be upgraded one level to Lv. 4 as interval exercise level 99*d*, and the last participant still uses the Lv. 3 as the exercise level.

According to the preferred embodiment of the present invention, the exercise level used by the participants performing the simulation exercise in group exercise will automatically follow the exercise level used by the trainer performing the demonstration exercise. And the exercise level used by the participants can also be adjusted according to their performance ranking, that is, the participants having lower fitness level can use lower exercise level to perform the simulation exercise, and the participants having higher fitness level can use higher exercise level to perform the simulation exercise. So that all the participants can get appropriate training profile and exercise results that meet their fitness level, and the exercise interest and motivation can be improved in the group exercise. And the participants won't be distracted from manually adjusting the exercise level of the exercise apparatuses.

Further, the exercise level of the exercise apparatus is adjusted to be lower for the participants who have lower fitness level and the exercise level of the exercise apparatus is adjusted to be higher for the participants who have higher fitness level, so the exercise level adjustment is more reasonable and effective for each the participant.

Further, by comparing the participants' exercise level to the trainer's exercise level makes the exercise level adjustment more reasonable.

Further, by displaying the performance ranking to the participants and periodically instructing the console to adjust the exercise level used by the participants according to the performance ranking can encourage the participants to achieve their best performance, and the performance ranking can also reasonably reflects the fitness level of all the participants to adjust the exercise level.

Preferably, in the group exercise system, the console 25 of each exercise participating equipment is provided for allowing the participants to decide whether to accept adjustment of the exercise level instructed by the computer 40 according to the performance ranking. Each participant can make the decision before the group exercise start or during the group exercise, so each participant can decide whether to synchronize the exercise level with the exercise level used by the trainer performing the demonstration exercise. For example, in FIG. 5, the participant having label "M" in the exercise level column decides not to synchronize the exercise level with the trainer's exercise level, the participant wants to manually set the exercise level in the group exercise. Incidentally, the participant having label "10-2" in the exercise level column decides to synchronize the exercise level with the trainer's exercise level but degrading two levels.

Figure 3:
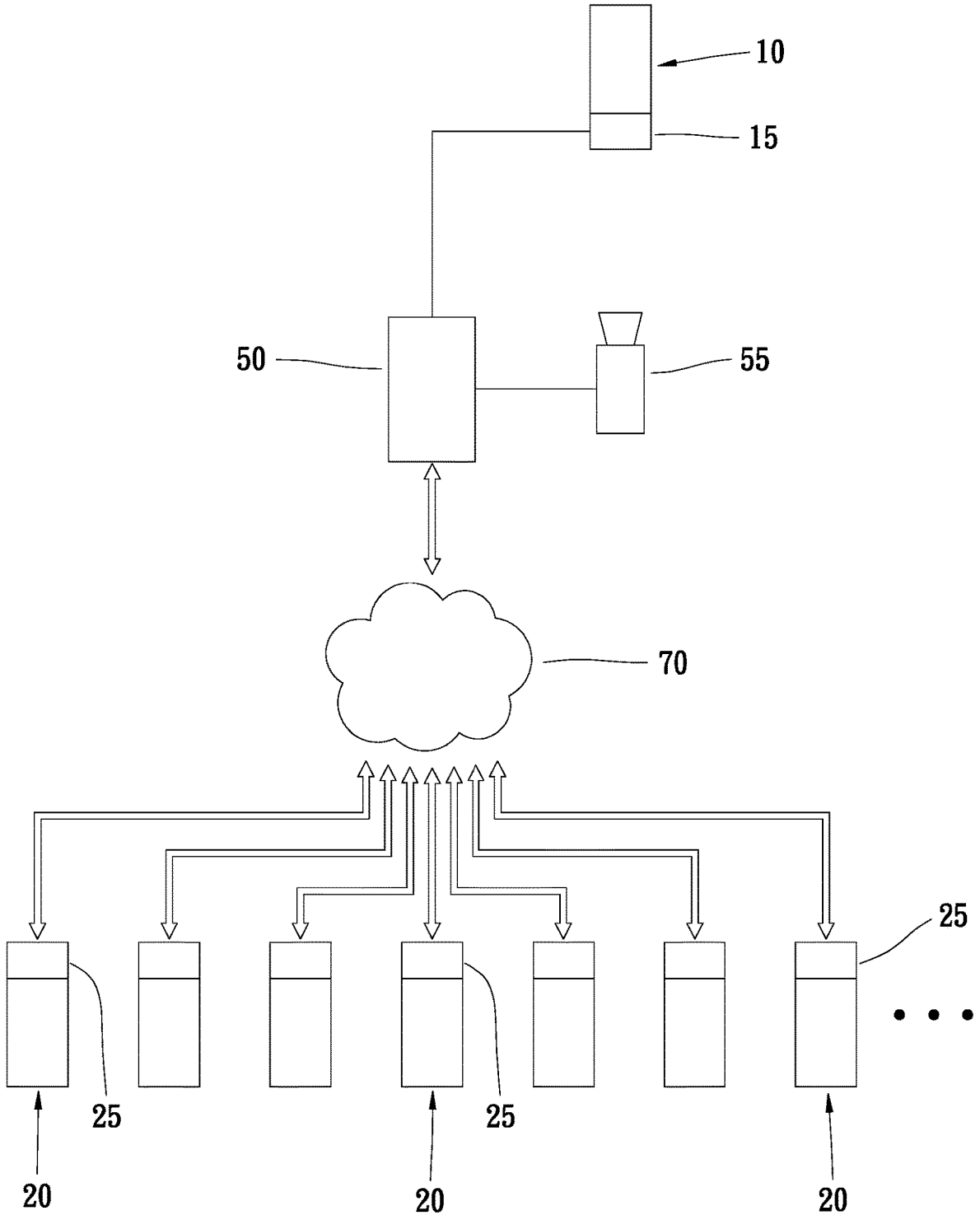
FIG. 3 illustrates a basic configuration of the group exercise system in accordance with another preferred embodiment of the present invention.

The group exercise system of the present invention, the place where the participants perform the simulation exercise using the second exercise apparatuses 20 may be different from the place where the trainer performs the demonstration exercise using the first exercise apparatus 10. In another preferred embodiment of the present invention, as shown in FIG. 3, a camera 55 is located at the place where the trainer performs the demonstration exercise for capturing image data of the demonstration exercise. The image data captured by the camera 55 is transmitted to the computer 50 and the computer 50 formats the captured image data into a live stream video and consequently uploads the live stream video to network 70 (includes a local network or a wide area network). The exercise participating equipment used by different participants may be placed at different places, such as at different floors of a fitness club or at the houses of the participants, and the console 25 of each exercise participating equipment receives the live stream video via the network 70 and displays the live stream video to each participant, so the participants can follow the trainer's exercise instructions to perform the simulation exercise. The performance data of each participant is transmitted to the computer 50 for measuring the performance ranking, and the computer 50 transmits the performance ranking to each exercise participating equipment and instructs the exercise participating equipment to adjust the exercise level if necessary. And exercise instructing equipment is constructed by the first exercise apparatus 10, the console 15, the camera 55 and the computer 50. The exercise instructing equipment provides the demonstration exercise information regarding the trainer using the first exercise apparatus to perform the demonstration exercise, and the demonstration exercise information includes the live stream video, the trainer's performance data and the exercise level, etc.

Figure 4:
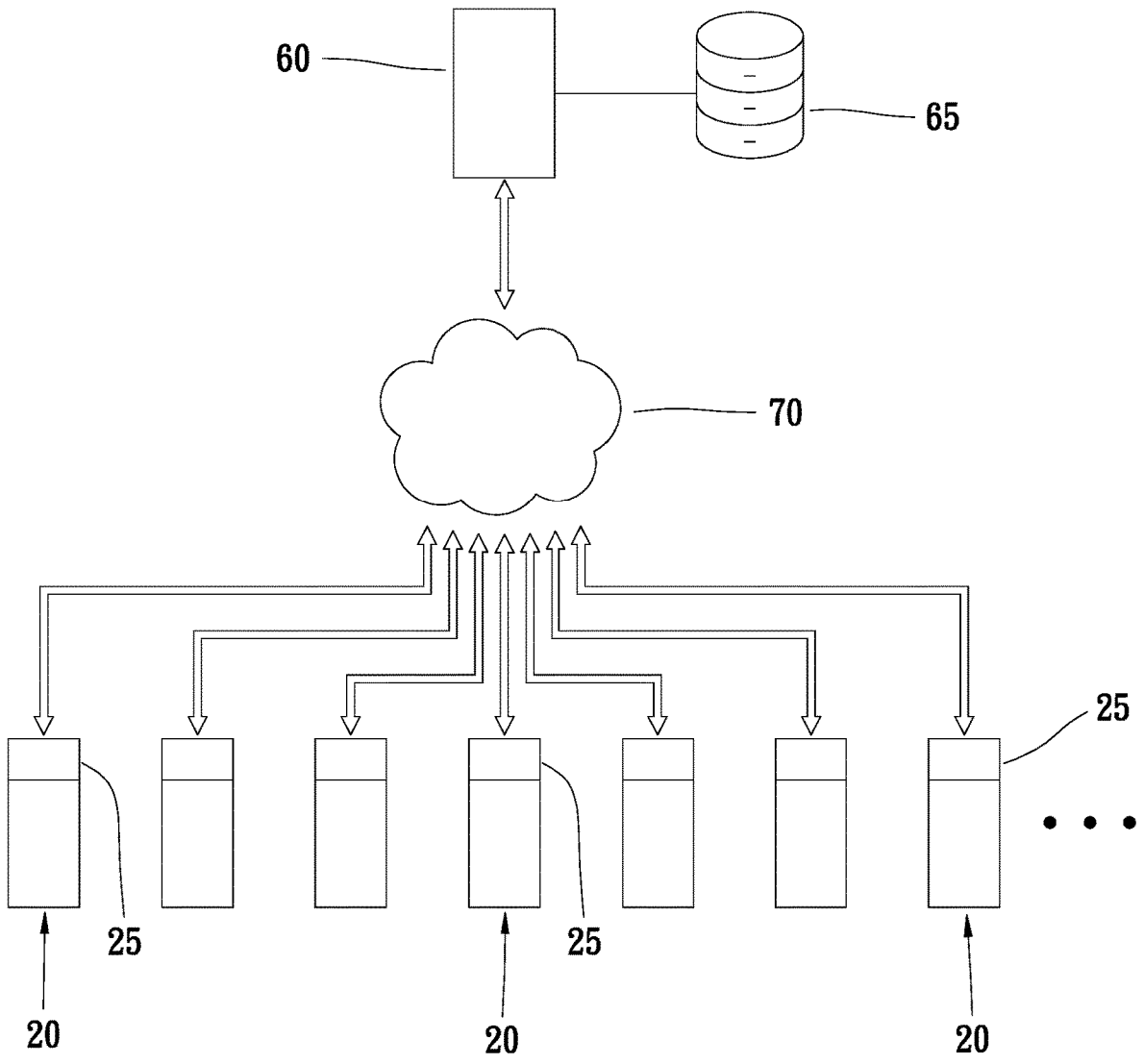
FIG. 4 illustrates a basic configuration of the group exercise system in accordance with another preferred embodiment of the present invention.

FIG. 4 illustrates another preferred embodiment of the present invention, an operator can provide class files of multiple exercise classes, each class file includes the demonstration exercise information regarding the trainer using the first exercise apparatus to perform the demonstration exercise, and the demonstration exercise information may include a pre-recorded video, the trainer's performance data and the used exercise level in the class, etc. The class files are stored in a storage 65 which is connected to a computer 60 via a network 70. The participants at different places can select an exercise class, and the exercise participating equipment subsequently receives and displays the pre-recorded video streaming corresponding to the selected exercise class, so that the participants can follow exercise instructions in the pre-recorded video to perform the simulation exercise. Similarly, each exercise participating equipment (including the second exercise apparatus 20 and the console 25) can bi-directional communicate with the exercise instructing equipment (including the computer 60 and the storage 65) via the network 70.

In accordance with the concept of the present invention, the computer 40, 50 and 60 in the above-mentioned preferred embodiment has a computing module (could be a software program) called a leaderboard module, the leaderboard module is configured to continuously update the performance ranking according to the performance data of each participant performing the simulation exercise during the group exercise period and display the performance ranking to all the participants. The computer 40, 50 and 60 also has a computing module called a level indication module, the level instruction module is configured to instruct the second electronic devices of all the exercise participating equipment to adjust the exercise level of the second exercise apparatus according to the exercise level of the first exercise apparatus and, if necessary, instruct the second electronic device of each exercise participating equipment to adjust the exercise level of the second exercise apparatus according to the performance ranking of each participant. In another embodiment of the present invention, the console coupled to the first exercise apparatus and/or the consoles coupled to the second exercise apparatuses in the group exercise system may implement the all or some functions of the leaderboard module and the level indication module.

The one purpose of the present invention is providing a method for adjusting exercise level in a group exercise, the group exercise is provided for allowing the participants respectively using the second exercise apparatuses to simultaneously perform the simulation exercise which is simulating a demonstration exercise performed by the trainer using the first exercise apparatus. The method comprises adjusting, according to the exercise level of the first exercise apparatus used by the trainer to perform the demonstration exercise, the exercise level of the second exercise apparatus used by each participant to perform the simulation exercise; during the group exercise period, continuously measuring the performance data of each participant performing the simulation exercise and updating the performance ranking of each participant according to the performance data; and at the one or more adjustment times in the group exercise period, adjusting the exercise level of the second exercise apparatus corresponding to the participant whose performance ranking is in a lower ranking range to be lower than the exercise level of the first exercise apparatus, and/or adjusting the exercise level of the second exercise apparatus corresponding to the participant whose performance ranking is in a higher ranking range to be higher than the exercise level of the first exercise apparatus.

According to the preferred embodiment of the present invention, the exercise level used by the participants performing the simulation exercise in group exercise will automatically follow the exercise level used by the trainer performing the demonstration exercise. And the exercise level used by the participants can also be adjusted according to the performance ranking of the participants, that is, the participants having lower fitness level can use lower exercise level to perform the simulation exercise, and the participants having higher fitness level can use higher exercise level to perform the simulation exercise. So all the participants can get appropriate training profiles and exercise results that meet their fitness level, and the exercise interest and motivation can be improved in the group exercise. And the participants won't be distracted from manually adjusting the exercise level of the exercise apparatuses. The detailed implement and possible results of the present invention could refer to the descriptions of the group exercise system.

It will be apparent to those skilled in the art that various modifications and variations can be made to the structure of the present invention without departing from the scope or spirit of the invention. In view of the foregoing, it is intended that the present invention cover modifications and variations of present invention provided they fall within the scope of the following claims and their equivalents.

What is claimed is:

1. A group exercise system, comprising:

an exercise instructing equipment having a first electronic device, the first electronic device configured to provide a demonstration exercise information of a trainer performing a demonstration exercise using a first exercise apparatus, the demonstration exercise information including an exercise level of the first exercise apparatus used by the trainer to perform the demonstration exercise;

a plurality of exercise participating equipment each having a second exercise apparatus and a second electronic device, the plurality of exercise participating equipment configured to enable a plurality of participants to perform a simulation exercise which is simulating the demonstration exercise using the respective second exercise apparatuses during a group exercise period, the second electronic device of each exercise participating equipment being operable to adjust, according to a command, an exercise level of the corresponding second exercise apparatus used by each participant to perform the simulation exercise and continuously measure a performance data of each participant during the group exercise period;

a leaderboard module configured to continuously update a performance ranking according to the performance data of each participant performing the simulation exercise during the group exercise period; and a level instruction module configured to instruct the second electronic devices of all the exercise participating equipment to adjust, according to the exercise level of the first exercise apparatus used by the trainer performing the demonstration exercise, the exercise level of the second exercise apparatus used by each participant performing the simulation exercise, and at one or more adjustment times in the group exercise period, the level instruction module instructs the second electronic device of each exercise participating equipment to adjust, according to the performance ranking of each participant, the exercise level of the second exercise apparatus;

wherein the level instruction module is operable to instruct the second electronic device of the exercise participating equipment corresponding to one of the plurality of participants whose performance ranking is in a lower ranking range to adjust the exercise level of the corresponding second exercise apparatus to be lower than the exercise level of the first exercise apparatus.

2. The group exercise system as claimed in claim 1, wherein the level instruction module is operable to instruct the second electronic device of the exercise participating equipment corresponding to one of the plurality of participants whose performance ranking is in a higher ranking range to adjust the exercise level of the corresponding second exercise apparatus to be higher than the exercise level of the first exercise apparatus.

3. The group exercise system as claimed in claim 2, wherein the higher ranking range includes the first two rankings, and the exercise level of the second exercise apparatus is adjusted to be higher if the performance ranking of the one of the plurality of participants is higher.

4. The group exercise system as claimed in claim 2, wherein the demonstration exercise information includes a performance data of the trainer performing the demonstration exercise using the first exercise apparatus, and the level instruction module instructs the second electronic device of the exercise participating equipment corresponding to the one of the plurality of participants whose performance ranking is in the higher ranking range and whose performance data is better than a predetermined degree of the performance data of the trainer to adjust the exercise level of the second exercise apparatus to be higher than the exercise level of the first exercise apparatus at the one or more adjustment times.

5. The group exercise system as claimed in claim 1, wherein the leaderboard module is operable to display the performance ranking to the plurality of participants during the group exercise period, and the level instruction module is operable to periodically instruct the second electronic device of each exercise participating equipment to adjust, according to the corresponding performance ranking, the exercise level of the second exercise apparatus during the group exercise period.

6. The group exercise system as claimed in claim 1, wherein the lower ranking range includes the last two rankings, and the exercise level of the second exercise apparatus is adjusted to be lower if the performance ranking of the one of the plurality of participants is lower.

7. The group exercise system as claimed in claim 1, wherein the demonstration exercise information includes a performance data of the trainer performing the demonstration exercise using the first exercise apparatus, and the level instruction module instructs the second electronic device of the exercise participating equipment corresponding to the one of the plurality of participants whose performance ranking is in the lower ranking range and whose performance data is worse than a predetermined degree of the performance data of the trainer to adjust the exercise level of the corresponding second exercise apparatus to be lower than the exercise level of the first exercise apparatus.

8. The group exercise system as claimed in claim 1, wherein the second electronic device of each of the plurality of exercise participating equipment is provided for allowing the plurality of participants to decide whether to accept adjustment of the exercise level instructed by the level indication module according to the performance ranking.

9. A method for adjusting exercise level in a group exercise, the group exercise is provided for allowing a plurality of participants respectively using a second exercise apparatus to simultaneously perform a simulation exercise which is simulating a demonstration exercise performed by a trainer using a first exercise apparatus, the method comprising:

adjusting, according to an exercise level of the first exercise apparatus used by the trainer to perform the demonstration exercise, an exercise level of the second exercise apparatus used by each participant to perform the simulation exercise;

during the group exercise period, continuously measuring a performance data of each participant performing the simulation exercise and updating a performance ranking of each participant according to the performance data; and at one or more adjustment times in the group exercise period, adjusting the exercise level of the second exercise apparatus corresponding to one of the plurality of participants whose performance ranking is in a lower ranking range to be lower than the exercise level of the first exercise apparatus, and/or adjusting the exercise level of the second exercise apparatus corresponding to one of the plurality of participants whose performance ranking is in a higher ranking range to be higher than the exercise level of the first exercise apparatus.

* * * * *